US006299515B1

(12) United States Patent
Beardsley et al.

(10) Patent No.: US 6,299,515 B1
(45) Date of Patent: Oct. 9, 2001

(54) CMP APPARATUS WITH BUILT-IN SLURRY DISTRIBUTION AND REMOVAL

(75) Inventors: Gary J. Beardsley, Underhill; Cuc Kim Huynh, Jericho; Steven J. Messier, Essex Junction; David L. Walker, Enosburg Falls, all of VT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/599,920

(22) Filed: Jun. 22, 2000

Related U.S. Application Data

(62) Division of application No. 09/143,554, filed on Aug. 31, 1998, now Pat. No. 6,135,865.

(51) Int. Cl.[7] ..... B24B 1/00
(52) U.S. Cl. ..... 451/285; 451/60; 451/446
(58) Field of Search ..... 451/60, 285, 446, 451/540, 543, 550

(56) References Cited

U.S. PATENT DOCUMENTS

| | | | | |
|---|---|---|---|---|
| 2,820,334 | * | 1/1958 | Touvay | 451/446 X |
| 4,927,432 | | 5/1990 | Budinger et al. . | |
| 4,954,141 | | 9/1990 | Takiyama et al. . | |
| 5,007,207 | * | 4/1991 | Phaal | 451/548 |
| 5,076,024 | * | 12/1991 | Akagawa et al. | 451/550 |
| 5,246,525 | | 9/1993 | Sato . | |
| 5,329,734 | | 7/1994 | Yu . | |
| 5,486,131 | * | 1/1996 | Cesna et al. | 451/285 X |
| 5,487,398 | | 1/1996 | Ohmi et al. . | |
| 5,489,233 | | 2/1996 | Cook et al. . | |
| 5,533,923 | | 7/1996 | Shamouillan et al. . | |
| 5,558,563 | | 9/1996 | Cote et al. . | |
| 5,584,146 | | 12/1996 | Shamouillan et al. . | |
| 5,609,719 | | 3/1997 | Hempel . | |
| 5,643,061 | | 7/1997 | Jackson et al. . | |
| 5,645,469 | | 7/1997 | Burke et al. . | |
| 5,650,039 | | 7/1997 | Talieh . | |
| 5,658,185 | * | 8/1997 | Morgan, III et al. | 451/288 X |
| 5,664,990 | * | 9/1997 | Adams et al. | 451/285 X |
| 5,690,540 | * | 11/1997 | Elliott et al. | 451/288 X |
| 5,762,537 | * | 6/1998 | Sandhu et al. | 451/285 X |
| 6,135,865 | * | 10/2000 | Beardsley et al. | 451/285 |

FOREIGN PATENT DOCUMENTS 58-211852 12/1983 (JP) .

* cited by examiner

*Primary Examiner*—Derris H. Banks
*Assistant Examiner*—Anthony Ojini
(74) *Attorney, Agent, or Firm*—Scully, Scott, Murphy & Presser; Howard J. Walter, Esq.

(57) ABSTRACT

A polishing apparatus for polishing a substrate. The polishing apparatus has a slurry delivery system for delivering slurry to the apparatus; a porous polishing pad having an upper surface at which the substrate is polished; and a rotating platen upon which the porous pad lies. The rotating platen has a recess which has a first portion in communication with the delivery means for delivering slurry into the first portion. The recess further has a second portion extending under the polishing pad. Slurry is delivered from the first portion to the second portion and to the upper surface of the pad where it aids in the polishing of the substrate. Preferably, the first portion of the recess is situated such that the slurry delivered to the top surface returns to the first portion for removal or reuse due to the rotational force of the rotating platen.

6 Claims, 7 Drawing Sheets

CM P APPARATUS WITH BUILT-IN SLURRY DISTRIBUTION AND REMOVAL

This Application is a Division of Ser. No. 09/143,554 filed Aug. 31, 1998, Pat. No. 6,135,865.

BACKGROUND OF THE INVENTION

1. Field of the Invention

The field of art to which this invention relates is semiconductor manufacturing techniques. Specifically, this-invention relates to apparatus and methods for planarizing semiconductor wafers.

2. Description of the Related Art

The manufacture of an integrated circuit device requires the formation of various layers (both conductive and non-conductive) above the base substrate to form the necessary components and interconnects. During the manufacturing process, removal of a certain layer or portions of a layer must be achieved in order to pattern and form the various components and interconnects. Generally this removal process is termed "etching" or "polishing."

One of the techniques available for removal is a chemical-mechanical polishing (hereinafter "CMP") process in which a chemical slurry is used along with a polishing pad. The mechanical movement of the pad relative to the wafer and the abrasive slurry provide the abrasive force for removing the exposed material off the wafer surface. Planarization is a method of treating a surface to remove discontinuities, such as by polishing (or etching), thereby "planarizing" the surface. Various methods and apparatus have been developed in the art for polishing semiconductor wafers. However, it has been found that during polishing, the load imposed on the wafer leads to a higher concentration of slurry contacting the wafer edges, than its center. As a result, there is greater polishing action at the edges, thus causing center-to-edge non-uniformity in thickness and poor flatness of the wafer.

FIG. 1 shows a typical apparatus for polishing a semiconductor wafer 1. The apparatus includes a wafer carrier 2 which is coupled to a spindle 3, which in turn is coupled to any suitable motor or driving means (not shown) for moving the carrier 2 in the directions indicated by arrows 4*a*, 4*b*, and 4*c* (rotation). The spindle 3 supports a load 5, which is exerted against the carrier 2 and thus against the wafer 2 during polishing. The carrier 2 also includes a wafer retaining ring 6, which prevents the wafer 1 from sliding out from under the carrier 2 as the carrier 2 moves. The semiconductor wafer 1, which is to be polished, is mounted to the carrier 2, positioned between the carrier 2 and the rotatable turntable assembly 7 located below the carrier 2. The turntable assembly 7 includes a polishing table 8, on which a polishing pad 9 is positioned, and the polishing table 8 is rotated around the shaft 10 in the direction indicated by arrow 11 by any suitable motor or driving means (not shown).

During polishing, a slurry (not shown) is introduced to the polishing pad 9 which works its way between the wafer carrier 2 and the pad 9. Due to the load 5 which is imposed on the wafer carrier 2, a higher concentration of slurry generally contacts the wafer edges, as previously noted, resulting in a greater polishing action at the edges.

Efforts have been made in the art to obtain a more uniform polishing action across the wafer surface. The prior art teaches the various mechanisms employed to maintain the process uniformity and regional rates of removal during the CMP process. These mechanisms generally pump slurry through the platen and a porous polishing pad thereby ensuring an adequate supply of slurry at the polishing surface of the polishing pad.

While this process has its advantages, it also has drawbacks. The prior art mechanisms are expensive and complicated. The conventional polishing systems cannot be easily reconfigured to provide the adequate slurry delivery mechanism. Additionally, the slurry distribution mechanisms of the prior art do not provide for removal and/or recycling of the used slurry.

SUMMARY OF THE INVENTION

Therefore, it is an object of the present invention to provide a CMP apparatus with a built-in slurry distribution system which is inexpensive and uncomplicated as compared to prior art slurry distribution systems.

It is another object of the present invention to provide a CMP apparatus with a built-in slurry distribution system which can be easily reconfigured from a conventional CMP apparatus.

It is yet another object of the present invention to provide a CMP apparatus with a built-in slurry distribution system which also removes slurry for disposal or reuse.

Accordingly, a polishing apparatus for polishing a substrate is provided. The polishing apparatus comprises delivery means for delivering slurry to the apparatus; a porous polishing pad having an upper surface at which the substrate is polished; and a rotating platen upon which the porous pad lies. The rotating platen has a recess. The recess has a first portion in communication with the delivery means for delivering slurry into the first portion, and a second portion extending under the polishing pad. Whereby, slurry is delivered from the first portion to the second portion and to the upper surface of the pad where it aids in the polishing of the substrate.

In a preferred embodiment of the polishing apparatus of the present invention, the first portion of the recess is situated such that the slurry delivered to the top surface returns to the first portion for removal or reuse due to the rotational force of the rotating platen and wafer to the movement of the carrier relative to the polishing pad.

In yet another preferred embodiment of the polishing apparatus of the present invention, the first portion of the recess is a circular groove formed on an outer edge of the rotating platen.

In yet other preferred embodiments of the polishing apparatus of the present invention the second portion of the recess is a diametrical groove extending from the circular groove substantially across a diameter of the rotating platen; the second portion of the recess is a spiral groove extending from the first portion towards a central portion of the rotating platen.

In still yet another embodiment of the polishing apparatus of the present invention, a sprinkler means is disposed in the second portion of the recess for spraying slurry into the porous pad. Preferably, the sprinkler means comprises; a sprinkler hose disposed in the second portion of the recess, the sprinkler hose having an outer wall defining an interior conduit in communication with the slurry in the second portion of the recess, the sprinkler hose further having a plurality of spray holes disposed in the outer wall of the hose, facing the porous pad, and in communication with both the second portion of the recess and the interior cavity of the sprinkler hose; and gas delivery means for delivering pressurized gas into the sprinkler hose thus forcing the slurry to spray from the plurality of holes towards the porous pad.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENTS

Figure 1:
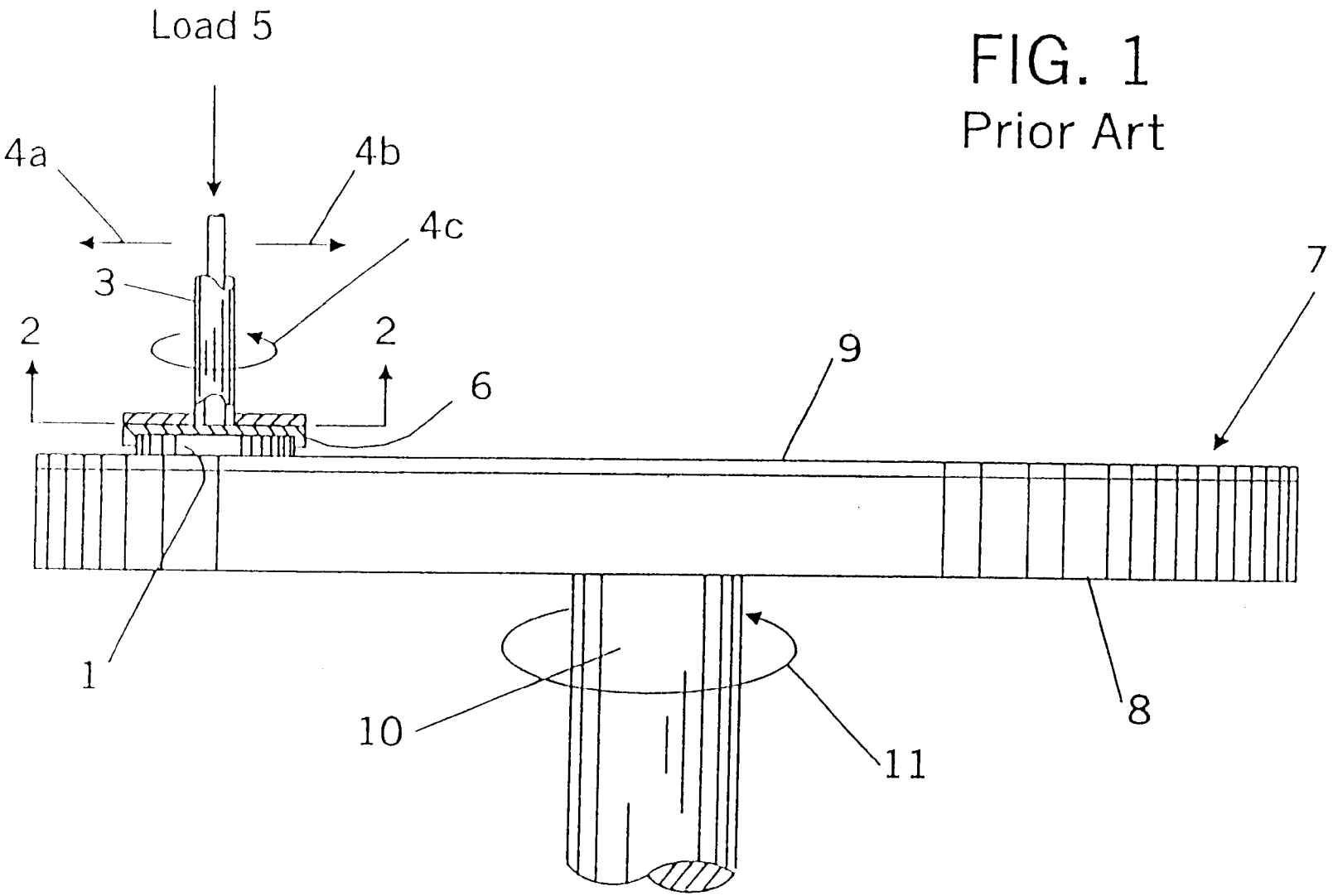
FIG. 1 Prior Art
FIG. 1 is a schematic illustration, partially in cross section, of a prior art apparatus for polishing a semiconductor wafer.
Figure 2:
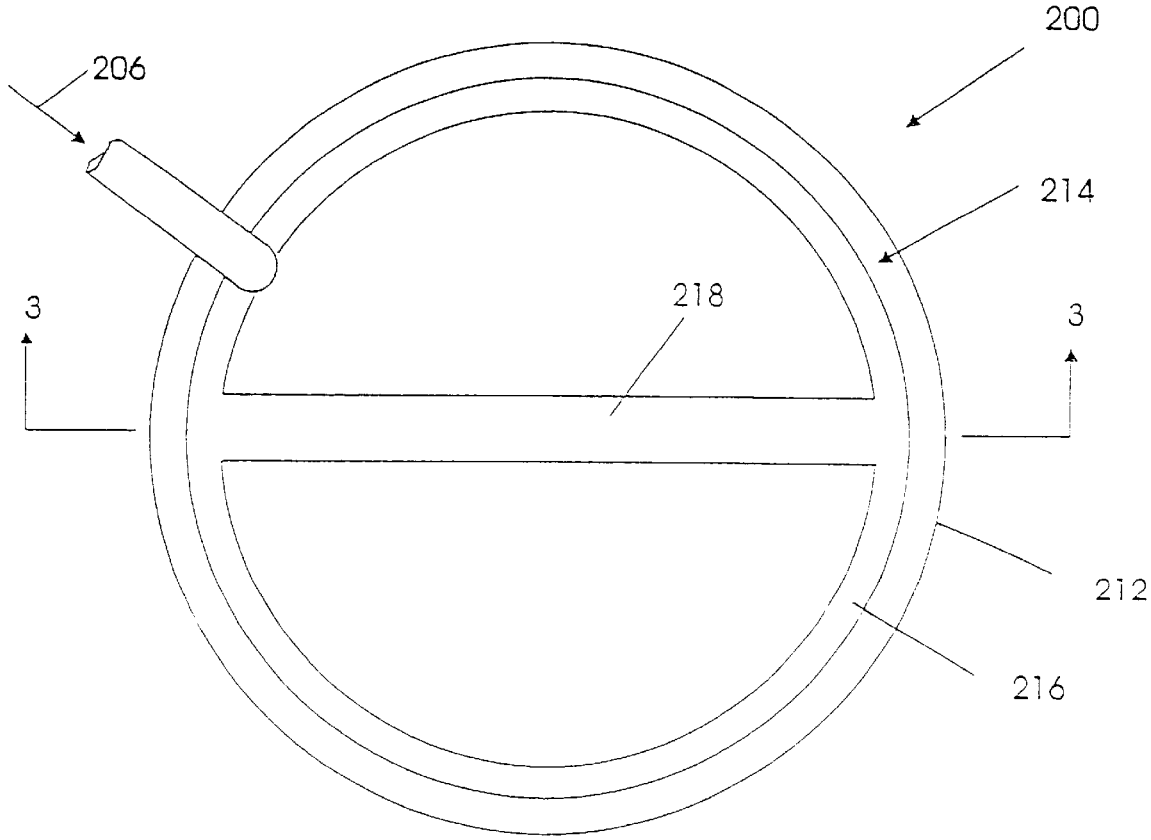
FIG. 2 is an illustration of a top view of a first embodiment of the polishing apparatus of the present invention shown without the porous polishing pad.
Figure 3:
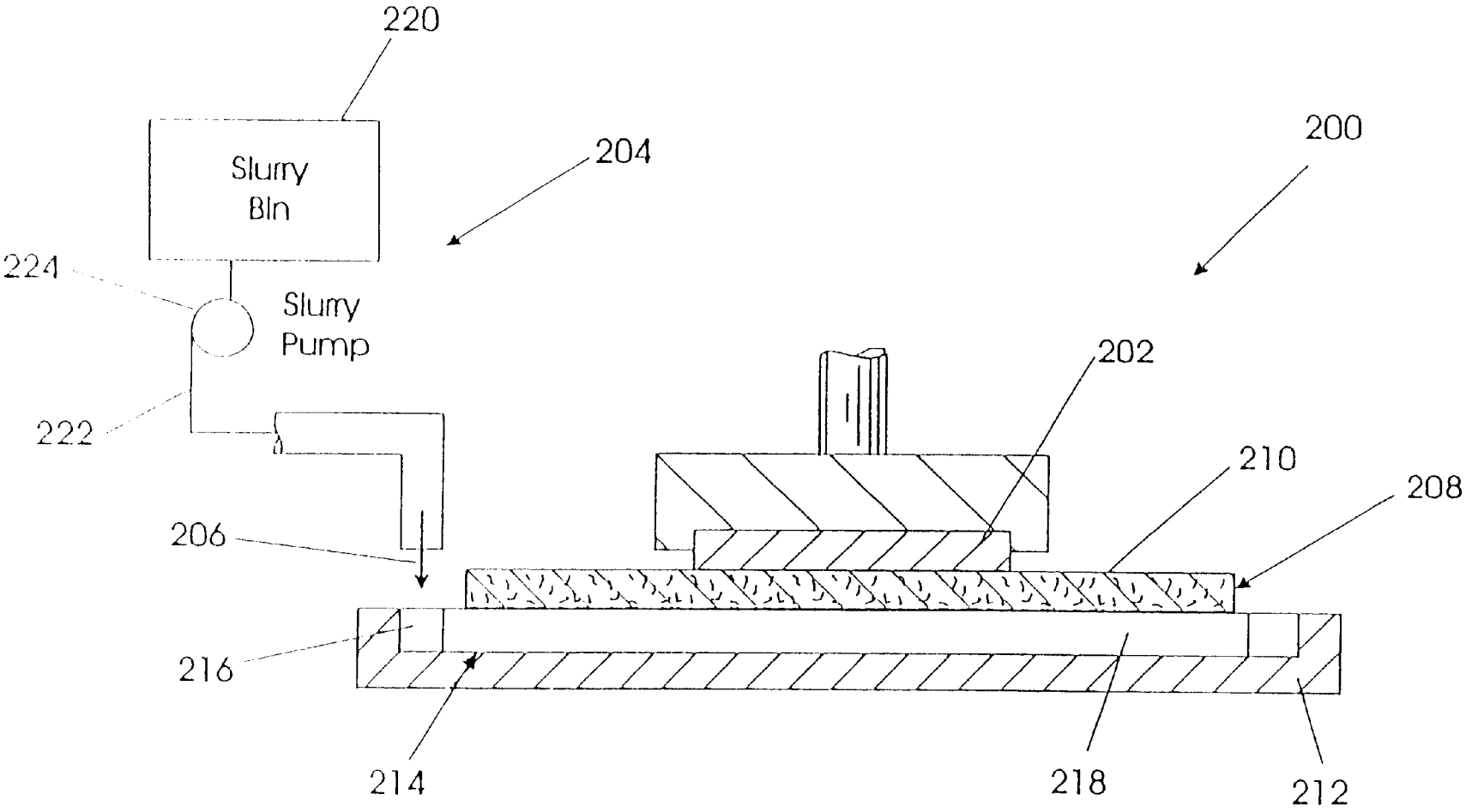
FIG. 3 is an illustration of a sectional view of the polishing apparatus of FIG. 2, taken along line 3—3, and shown with the porous polishing pad, wafer carrier, and wafer.

Referring now to FIGS. 2 and 3, there is illustrated a first embodiment of a polishing apparatus of the present invention, referred to generally by reference numeral 200. The polishing apparatus 200 is for polishing a substrate 202, such as a semiconductor wafer. The polishing apparatus 200 includes a slurry delivery means 204 for delivering slurry 206 to the polishing apparatus 200.

The slurry delivery means 204 is not unlike those typically employed in the art. Preferably, the slurry delivery means comprises a bin 220 of slurry 206 with a conduit 222 of suitable size and material connected at one end to the bin 220 and in communication with the first portion 216 of the recess 214 at another end. A pump 224 is disposed in the conduit 222 for pumping slurry 206 from the bin 220 to the first portion 216 of the recess 214. Typically, the pump 224 is gravity fed and manually controlled by an operator of the apparatus. However, the pump 224 can alternatively be automated under the control of suitable sensors (not shown) and a processor (not shown).

A porous polishing pad 208 is also provided. The porous polishing pad 208 has an upper surface 210 at which the substrate 202 is polished. The porous polishing pad 208 sits upon a rotating platen 212. The platen has a recess which has a first portion 216 in communication with the slurry delivery means 204 for delivering the slurry 206 into the first portion 216. The recess 214 also has a second portion 218, at least a portion of which, extends under the pad 208.

In a first embodiment of the polishing apparatus of the present invention, as shown in FIGS. 2 and 3, the polishing pad 208 sits above the surface of the platen 212. The first portion 216 of the recess 214 is a circular, or annular groove disposed on an outer edge of the platen 212. The second portion 218 of the recess 214 extends from the first portion 216 diametrically across the platen 214 and preferably extends back to the first portion 216 of the recess 214 at the other end of the platen 212, as clearly shown in FIG. 2.

Figure 4:
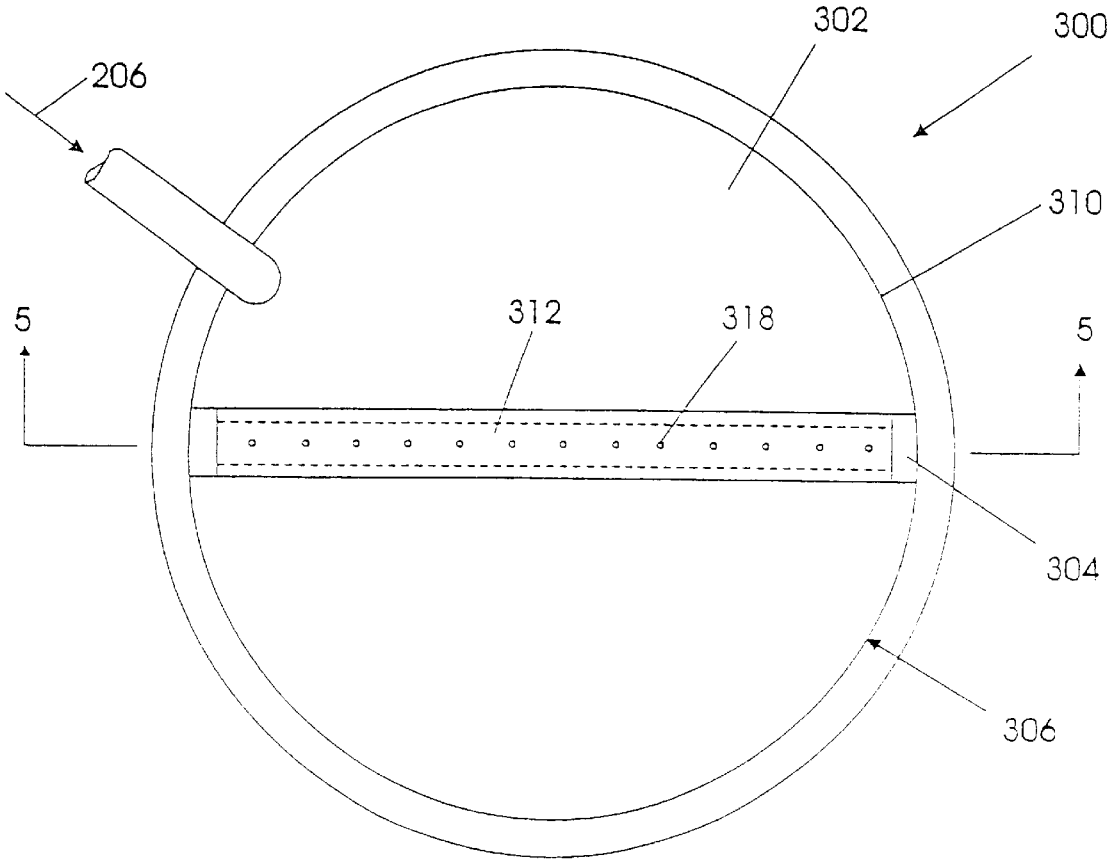
FIG. 4 is an illustration of a top view of a second embodiment of the polishing apparatus of the present invention shown without the porous polishing pad.
Figure 5:
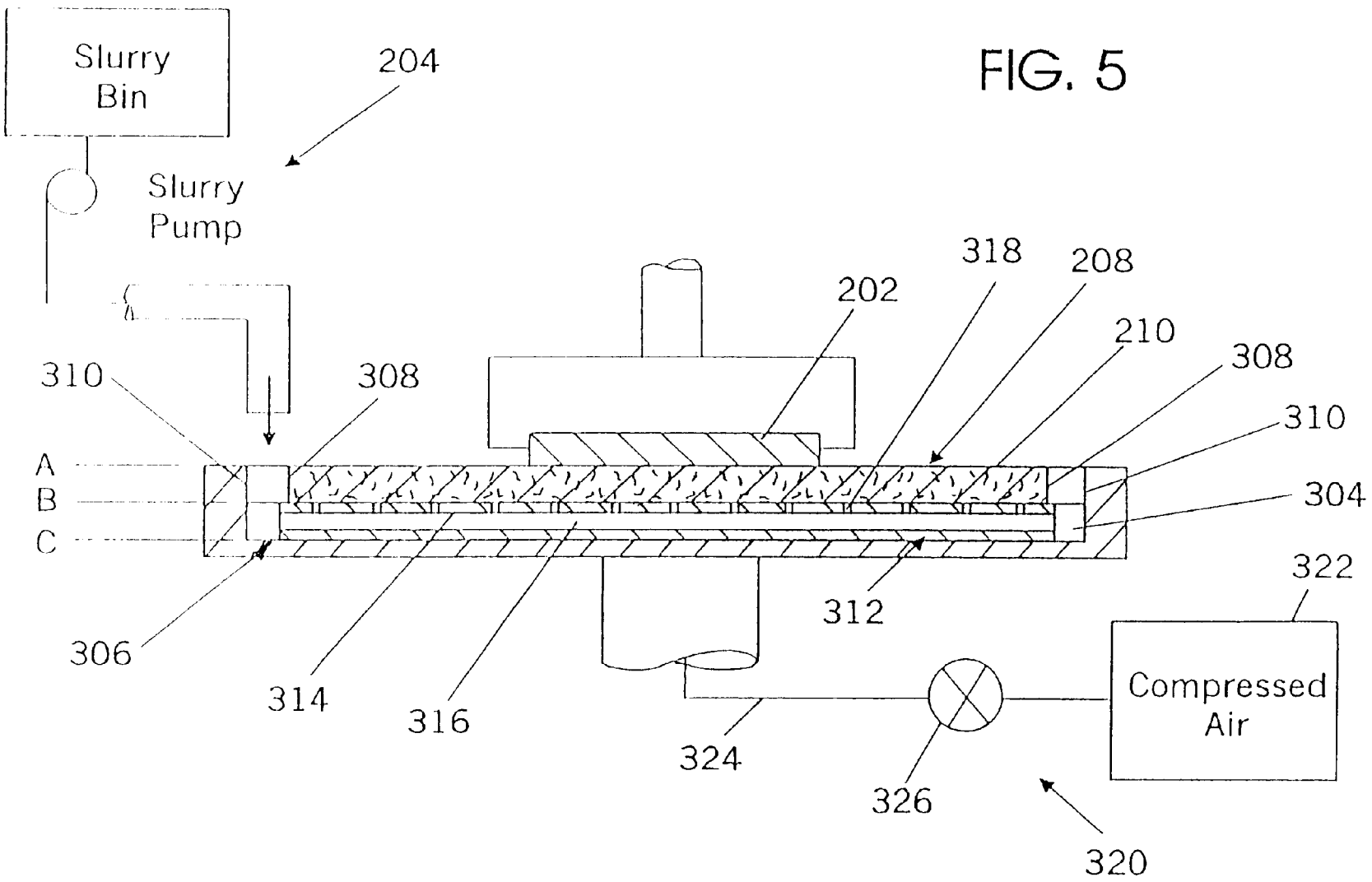
FIG. 5 is an illustration of a sectional view of the polishing apparatus of FIG. 2, taken along line 5—5, and shown with the porous polishing pad, wafer carrier, and wafer.

Referring now to FIGS. 4 and 5, there is illustrated a second embodiment of the polishing apparatus of the present invention, referred to generally by reference numeral 300, in which similar elements are referred to by like reference numerals. The second embodiment differs from that of the first in that first and second portions 302, 304, respectively, of the recess 306 are at first and second levels within the platen 212, and where an edge 308 of the porous pad 208 forms one wall of the first portion 302 of the recess 306.

Referring now to FIG. 5, the platen can be viewed as having three levels, A, B, and C. Level A being the top level which is preferably substantially flush with the top surface 210 of the polishing pad 208. Level B is the first level below the top surface 210 of the polishing pad 208 and its depth is preferably equivalent to the thickness of the polishing pad 208. The first portion 302 of the recess 306, like the polishing pad 208, are preferably round in shape with the first recess 302 having a larger diameter than the polishing pad 208. When the polishing pad 208 sits within the first portion 302 of the recess 306, the edge 308 of the polishing pad 208 and a wall 310 of the first portion 302 of the recess 306 forms an annular groove much like that of the first embodiment. Between level B and a second level below the top surface 210 of the polishing pad 208, denoted as level C, is the second portion 304 of the recess 306. Like the first embodiment of the polishing apparatus of the present invention, the second portion 304 of the recess 306 extends under the polishing pad 208.

As discussed above, the shape of the first portion 216, 302 of the recess 214, 306, respectively is preferably circular, or annular, disposed at an outer edge of the platen 212 and the shape of the second portion 216, 304 of the recess 214, 306 is preferably diametrical, extending across the diameter of the platen 212 from one end to another end.

Referring now to FIG's 6–9, there is illustrated several other possible configurations of the first and second portions of the recess.

Figure 6:
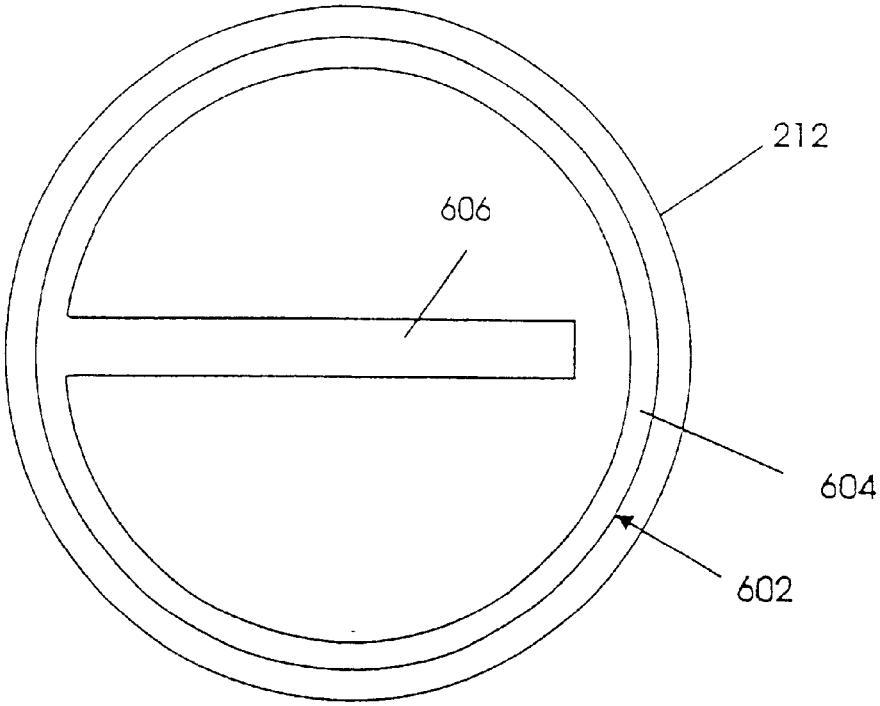
FIG. 6 is an illustration of a top view of an alternative platen for use in the polishing apparatus of the present invention.

Referring now specifically to FIG. 6, there is illustrated an alternative recess 602 wherein the first portion 604 of the recess 602 is a circular groove and wherein the second portion 606 of the recess 602 is a diametrical groove extending from the first portion 604 diametrically across the diameter of the rotating platen 212 but does not extend back to the first portion 604 of the recess 602. Thus, the second portion 606 of the recess 602, is blocked at one end from communicating with the first portion 602 of the recess 604.

Figure 7:
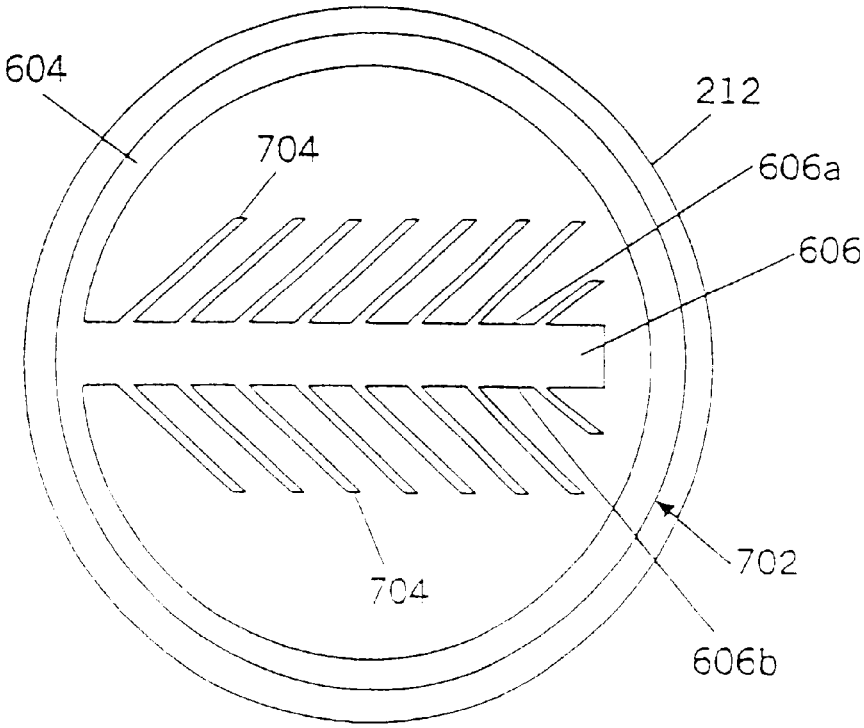
FIG. 7 is an illustration of a top view of yet another alternative platen for use in the polishing apparatus of the present invention.

Referring now specifically to FIG. 7, there is illustrated another alternative recess 702 which is similar to the recess configuration illustrated in FIG. 6 except that the second portion 606 of the recess 702, further has a plurality of capillary grooves extending from it and under the polishing pad. The plurality of capillary grooves 704 are preferably equally spaced, parallel to each other, and extend at an acute angle from each side 606*a*, 606*b* of the diametrical groove 606. The width of the capillary grooves 704 is preferably smaller than the width of the diametrical groove 606, but large enough so as not to restrict the free flow of slurry 206 within them.

Figure 8:
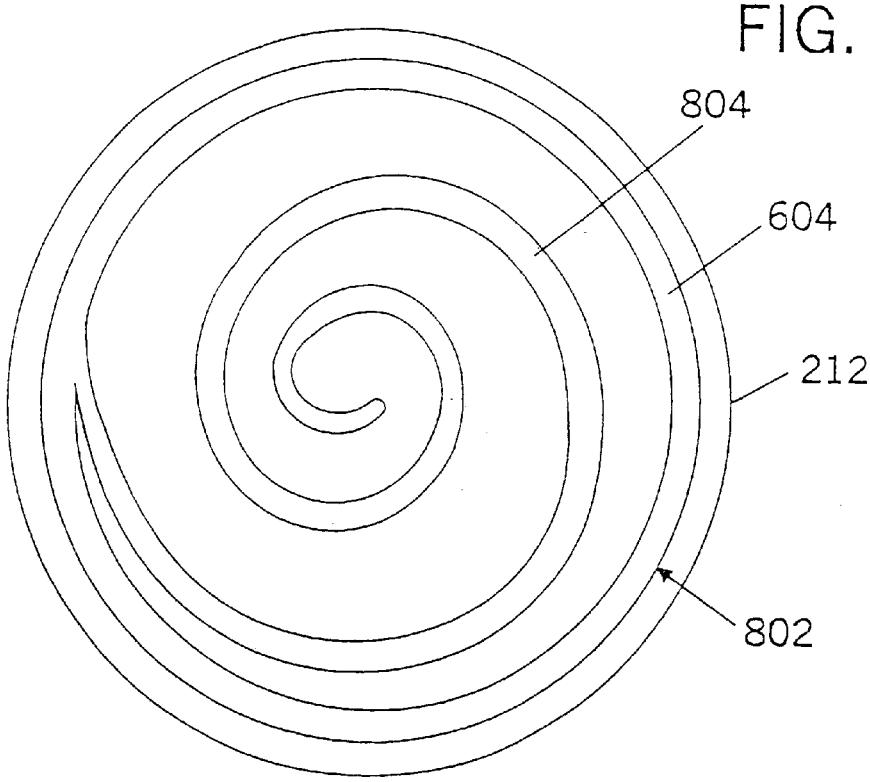
FIG. 8 is an illustration of a top view of yet another alternate platen for use in the polishing apparatus of the present invention.

Referring now specifically to FIG. 8, there is illustrated yet another alternative recess 802 in which the first portion 604 of the recess 802 is a circular groove formed on an outer edge of the rotating platen 212. However, the second portion 804 is a spiral groove extending spirally from the first portion 604 towards a central portion of the rotating platen 212.

Figure 9:
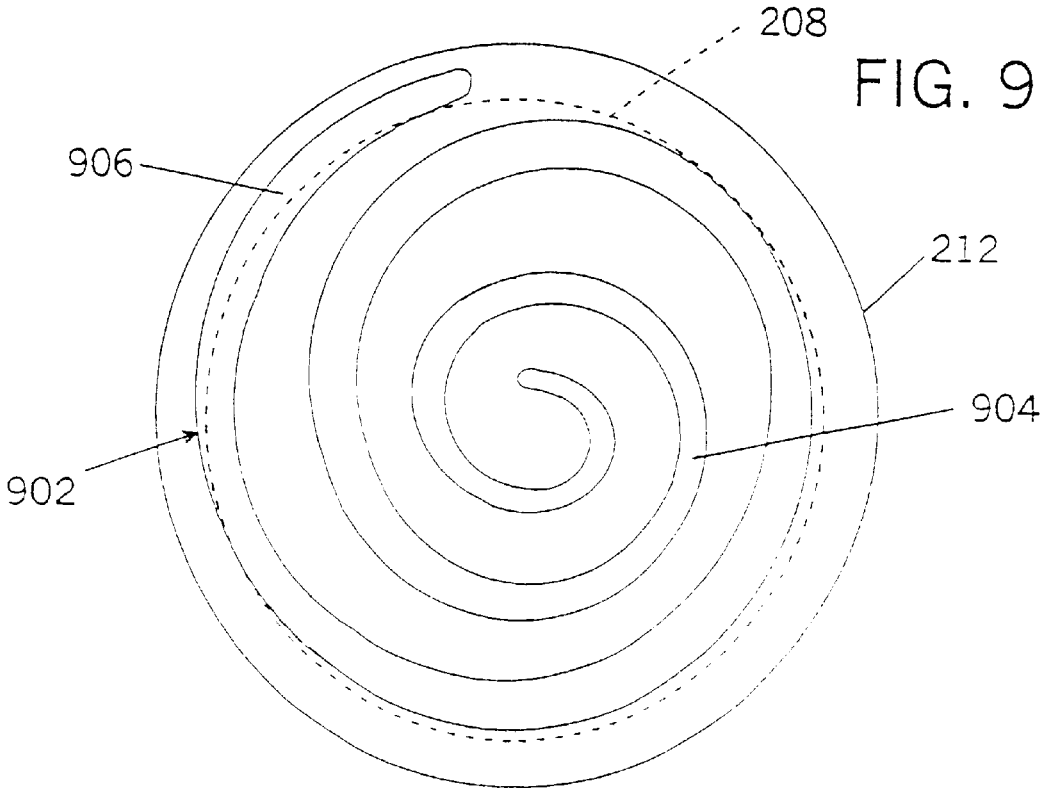
FIG. 9 is an illustration of a top view of still yet another alternate platen for use in the polishing apparatus of the present invention.

Referring now specifically to FIG. 9, there is illustrated still yet another alternative recess 902 in which the recess 902 is a spiral groove beginning on an outer edge of the rotating platen 212 and extending spirally towards a central portion of the rotating platen 212. The polishing pad 208, shown in phantom by dotted line, covers the second portion 904 of the spiral groove but does not extend over the entire spiral groove as can be seen by the dotted line. Thus, the portion of the spiral groove not covered by the platen 212 comprises the first portion 906 of the spiral groove which is in communication with the slurry distribution means 204.

It should be apparent to someone skilled in the art that the recess configurations discussed with relation to FIGS. 6–9, although shown with regard to the first embodiment, are equally applicable to either of the first or second embodiments of the polishing apparatus of the present invention.

The operation of the polishing apparatus of the present invention will now be described with regard to FIG. 3. Slurry 206 from the slurry distribution means 204 is delivered by any of the know means of the prior art to the first portion 216 of the recess 214. The slurry 206 fills the first portion 216 of the recess 214 and flows to the second portion 218 of the recess 214 which is in communication with the first portion 216. The slurry makes its way from the second portion 218 of the recess 214 to the upper surface 210 of the porous pad 208 due to wicking action and the normal force exerted to the top surface 210 of the pad 208 from the substrate 202 and carrier. The slurry is distributed between the substrate 202 and the top surface 210 of the pad 208 where it aids in the polishing of the substrate and eliminates the aforementioned deficiencies of the prior art.

In addition to the above distribution, the first portion 216 of the recess 214 can be situated on the platen 212 such that the slurry 206 delivered to the top surface 210 of the pad 208 is returned to the first portion 216 of the recess 214 for removal or reuse. This is due both to the rotational force of the rotating platen 212 and the movement of the carrier which translates about the pad 208 and thus pushes the slurry 206 into the first portion 216 of the recess 214 when it translates near the outer edge of the platen 212 where the first portion 216 of the recess 214 is situated. Preferably, in such a configuration, the first portion 216 of the recess 214 is a circular, or annular groove, as discussed above.

Referring back to FIGS. 4 and 5, as a means to further ensure the distribution of slurry 206 from the second portion 304 of the recess 306 to the top surface 210 of the polishing pad 208 a sprinkler means is disposed in the second portion 304 of the recess 306 for spraying slurry 206 into the porous pad 208. The sprinkler means preferably comprises a sprinkler hose 312 disposed in the second portion 304 of the recess 306. The sprinkler hose 312 has an outer wall 314 defining an interior conduit 316 in communication with the slurry 206 in the second portion 304 of the recess 306. The sprinkler hose 312 further has a plurality of spray holes 318 disposed in the outer wall 314 of the sprinkler hose 312 which face the porous pad 208. The spray holes 318 are in communication with the interior cavity 316 of the sprinkler hose 312. The sprinkler means also preferably includes a gas delivery means 320 for delivering pressurized gas into the sprinkler hose 312. The gas is preferably compressed air and the gas delivery means preferably comprises a canister 322 of pressurized air in communication with the sprinkler hose 312 via a conduit 324 and a valve 326 disposed in the conduit 324 for controlling the delivery of air to the sprinkler hose 312. A rotating seal (not shown) is used to provide a seal between the conduit 324 and the rotating shaft of the platen 212.

In operation, the slurry delivered to the first portion 302 of the recess 306 flows into the interior cavity 316 of the spray hose 312 which is in communication with the second portion 304 of the recess 306. When the valve 326 is opened, compressed air flows into the interior cavity 316 of the spray hose 312 and forces the slurry 206 in the interior cavity 316 to spray from the plurality of holes 318 towards the porous pad 208.

It should be apparent to someone skilled in the art, that the sprinkler means, although described in relation to the second embodiment of the polishing apparatus of the present invention, is equally applicable for use in the first embodiment discussed above and illustrated in FIGS. 2 and 3.

While there has been shown and described what is considered to be preferred embodiments of the invention, it will, of course, be understood that various modifications and changes in form or detail could readily be made without departing from the spirit of the invention.- It is therefore intended that the invention be not limited to the exact forms described and illustrated, but should be constructed to cover all modifications that may fall within the scope of the appended claims.

Having thus described our invention, what we claim as new, and desire to secure by Letters Patent is:

1. A polishing apparatus for polishing a substrate, the polishing apparatus comprising:

slurry delivery means for delivering slurry to the apparatus, a porous polishing pad having an upper surface at which the substrate is polished, and a rotating platen upon which the porous pad lies, the platen having a recess, the recess having a first portion in communication with the slurry delivery means for delivering slurry into the first portion, and a second portion extending under the pad, whereby slurry is delivered from the first portion to the second portion and to the upper surface of the pad where the pad aids in the polishing of the substrate, wherein said first portion of the recess is a circular groove formed on an outer edge of the rotating platen and said second portion of the recess is a diametrical groove extending from the circular groove substantially across a diameter of the rotating platen.

2. The apparatus of claim 1, wherein an edge of the porous pad forms one wall of the first portion of the recess.

3. The apparatus of claim 1, wherein the first portion of the recess is situated such that the slurry delivered to the top surface returns to the first portion for removal or reuse due to the rotational force of the rotating platen.

4. The apparatus of claim 1, wherein the diametrical groove extends from the circular groove across the diameter of the rotating platen and back to the circular groove.

5. The apparatus of claim 1, wherein the substrate is a semiconductor wafer.

6. The apparatus of claim 1, wherein the slurry delivery means comprises:

a bin of slurry, conduit connected at one end to the bin and in communication with the first portion of the recess at another end, and a pump disposed in the conduit for pumping slurry from the bin to the first portion of the recess.

* * * * *